US010280548B2

(12) United States Patent
Leibman et al.

(10) Patent No.: US 10,280,548 B2
(45) Date of Patent: May 7, 2019

(54) WASHING MACHINE APPLIANCES WITH REMOVABLE WASH BASINS

(71) Applicant: Haier US Appliance Solutions, Inc., Wilmington, DE (US)

(72) Inventors: Alexander B. Leibman, Prospect, KY (US); Manidhar V V S Yandamuri, Hyderabad (IN); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 115 days.

(21) Appl. No.: 15/448,659

(22) Filed: Mar. 3, 2017

(65) Prior Publication Data

US 2018/0251929 A1 Sep. 6, 2018

(51) Int. Cl.

| | |
|---|---|
| ***D06F 37/26*** | (2006.01) |
| ***D06F 39/02*** | (2006.01) |
| ***D06F 39/14*** | (2006.01) |
| ***D06F 23/04*** | (2006.01) |
| ***D06F 39/00*** | (2006.01) |

(52) U.S. Cl.

CPC ..... *D06F 37/267* (2013.01); *D06F 23/04* (2013.01); *D06F 39/005* (2013.01); *D06F 39/022* (2013.01); *D06F 39/14* (2013.01)

(58) Field of Classification Search

None

See application file for complete search history.

(56) References Cited

U.S. PATENT DOCUMENTS

| | | | | |
|---|---|---|---|---|
| 3,145,551 | A * | 8/1964 | Ziegler | D06F 13/00 210/380.2 |
| 3,209,560 | A | 10/1965 | Shelton | |
| 5,253,493 | A * | 10/1993 | Ohashi | D06F 39/14 220/812 |
| 8,459,067 | B2 | 6/2013 | Kendall et al. | |
| 9,404,213 | B2 | 8/2016 | Kappler | |
| 2013/0115130 | A1* | 5/2013 | Kappler | D06F 95/002 422/5 |
| 2015/0184326 | A1* | 7/2015 | Seo | D06F 37/24 68/132 |
| 2015/0247276 | A1* | 9/2015 | Kim | D06F 39/08 68/27 |
| 2015/0275413 | A1* | 10/2015 | Kim | D06F 37/18 68/27 |
| 2015/0299927 | A1* | 10/2015 | Kim | D06F 31/00 68/27 |

FOREIGN PATENT DOCUMENTS

| | | | |
|---|---|---|---|
| JP | 53111666 | A | 9/1978 |
| KR | 100220751 | B1 | 9/1999 |

* cited by examiner

*Primary Examiner* — Jason Y Ko

*Assistant Examiner* — Cristi J Tate-Sims

(74) *Attorney, Agent, or Firm* — Dority & Manning, P.A.

(57) ABSTRACT

A washing machine appliance includes a cabinet, the cabinet including a top panel which defines an opening. The washing machine appliance further includes a tub positioned within the cabinet, and a wash basket rotatably mounted within the tub, the wash basket defining a wash chamber for receiving articles for washing. The washing machine appliance further includes a wash basin removably positionable within the opening, the wash basin including a first sidewall and an opposing second sidewall.

14 Claims, 6 Drawing Sheets

WASHING MACHINE APPLIANCES WITH REMOVABLE WASH BASINS

FIELD OF THE INVENTION

The present subject matter relates generally to washing machine appliances and more particularly to washing machine appliances having removable wash basins.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

One issue with many conventional washing machine appliances is that consumers have no place to allow articles to soak before washing. For example, a consumer may desire to pretreat an article to be washed. In many conventional washing machine appliances, there is not an adequate surface or component on which to perform such activities. Accordingly, such activities must be performed in a separate utility sink, a kitchen sink, or in another suitable location using apparatus separate from the washing machine appliance. This can be inconvenient and time-consuming for the consumer.

Recently, various washing machine appliances have attempted to include integrated components which allow for such activities. However, known such components are constantly in the way of the consumer and are difficult to clean. Accordingly, such known washing machine appliances are still inconvenient and time-consuming for the consumer.

Accordingly, improved apparatus for allowing convenient pre-treatment options in association with washing machine appliances are desired.

BRIEF DESCRIPTION OF THE INVENTION

Aspects and advantages of the invention will be set forth in part in the following description, or may be apparent from the description, or may be learned through practice of the invention.

In accordance with one embodiment, a washing machine appliance defining a vertical, a lateral, and a transverse direction is provided. The washing machine appliance includes a cabinet, the cabinet including a top panel which defines an opening, the top panel including a convex surface defining the opening. The washing machine appliance further includes a tub positioned within the cabinet, and a wash basket rotatably mounted within the tub, the wash basket defining a wash chamber for receiving articles for washing. The washing machine appliance further includes a wash basin removably positionable within the opening, the wash basin including a first sidewall and an opposing second sidewall. The first and second sidewalls each have convex shapes which correspond to the convex surface defining the opening.

In accordance with another embodiment, a washing machine appliance defining a vertical, a lateral, and a transverse direction is provided. The washing machine appliance includes a cabinet, the cabinet including a top panel which defines an opening. The washing machine appliance further includes a tub positioned within the cabinet, and a wash basket rotatably mounted within the tub, the wash basket including a balance ring and defining a wash chamber for receiving articles for washing. The washing machine appliance further includes a wash basin removably positionable within the opening, the wash basin including an upper portion, a lower portion, and a step disposed between and defining the upper portion and the lower portion, the upper portion including a first sidewall and an opposing second sidewall. A gap is defined along the lateral direction between the lower portion and the balance ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
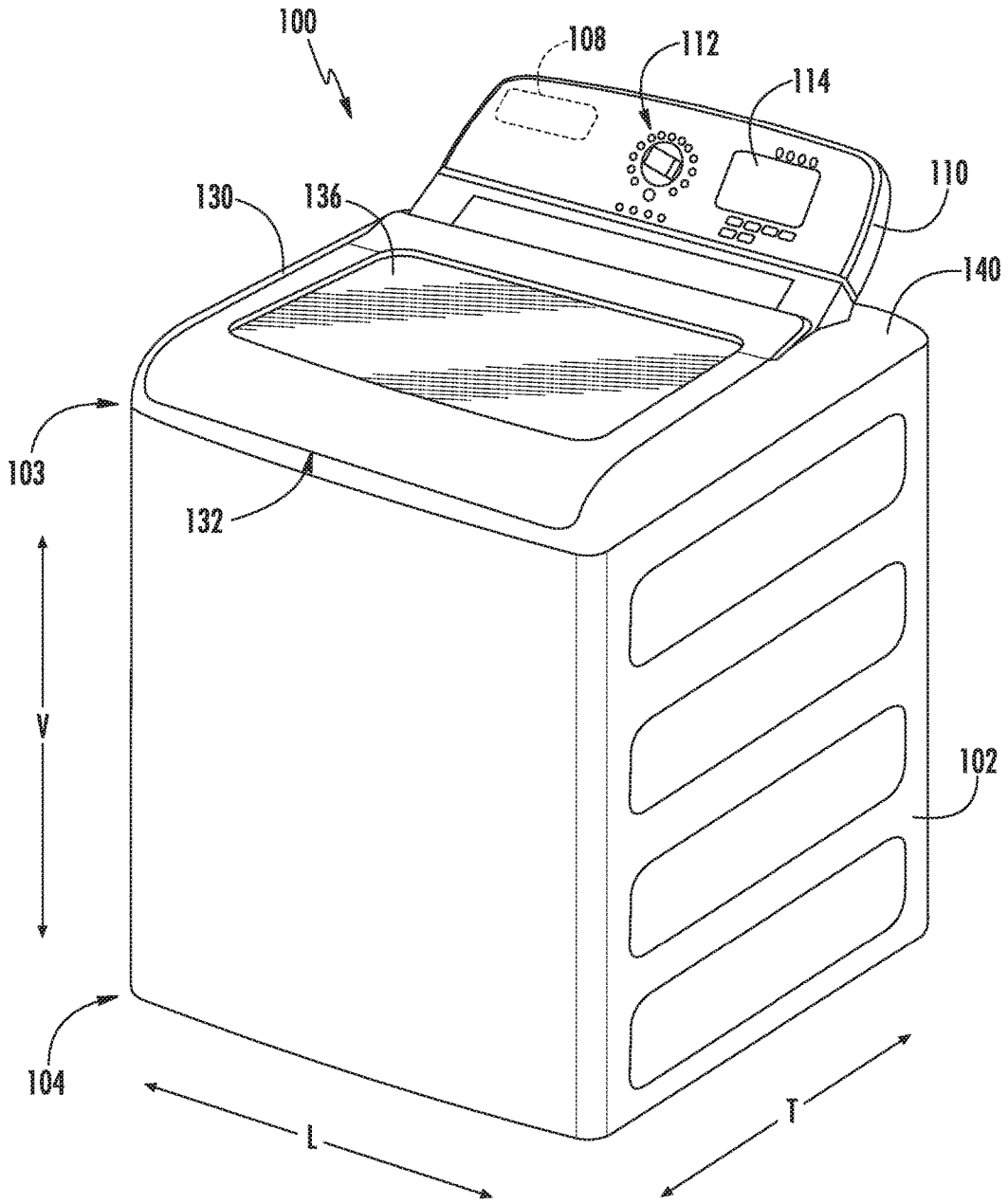
FIG. 1 provides a perspective view of a washing machine appliance according to embodiments of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
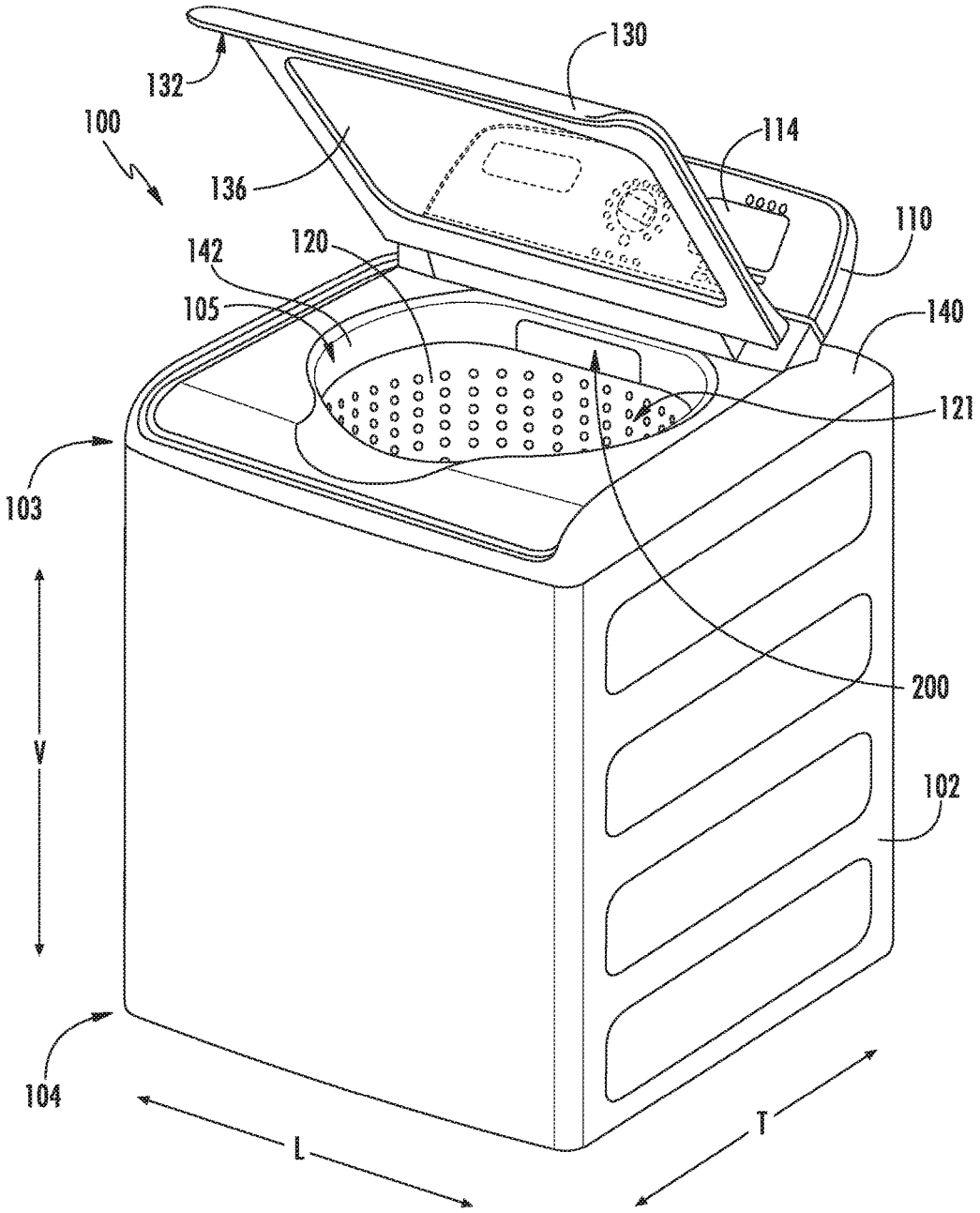
FIG. 2 provides a perspective view of the washing machine appliance of FIG. 1 with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via additive dispenser 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
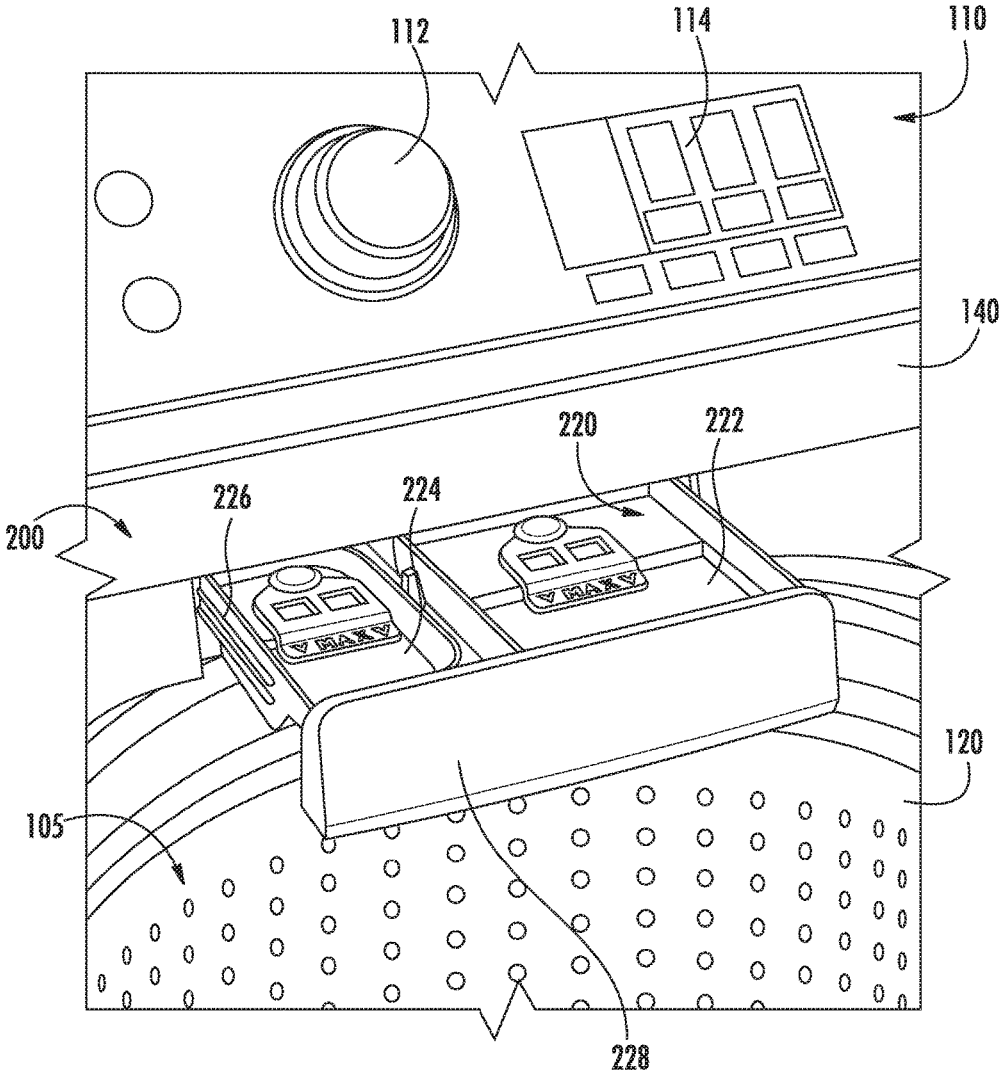
FIG. 3 provides a front, perspective view of an additive dispenser installed in a washing machine appliance according to embodiments of the present subject matter.
Figure 4:
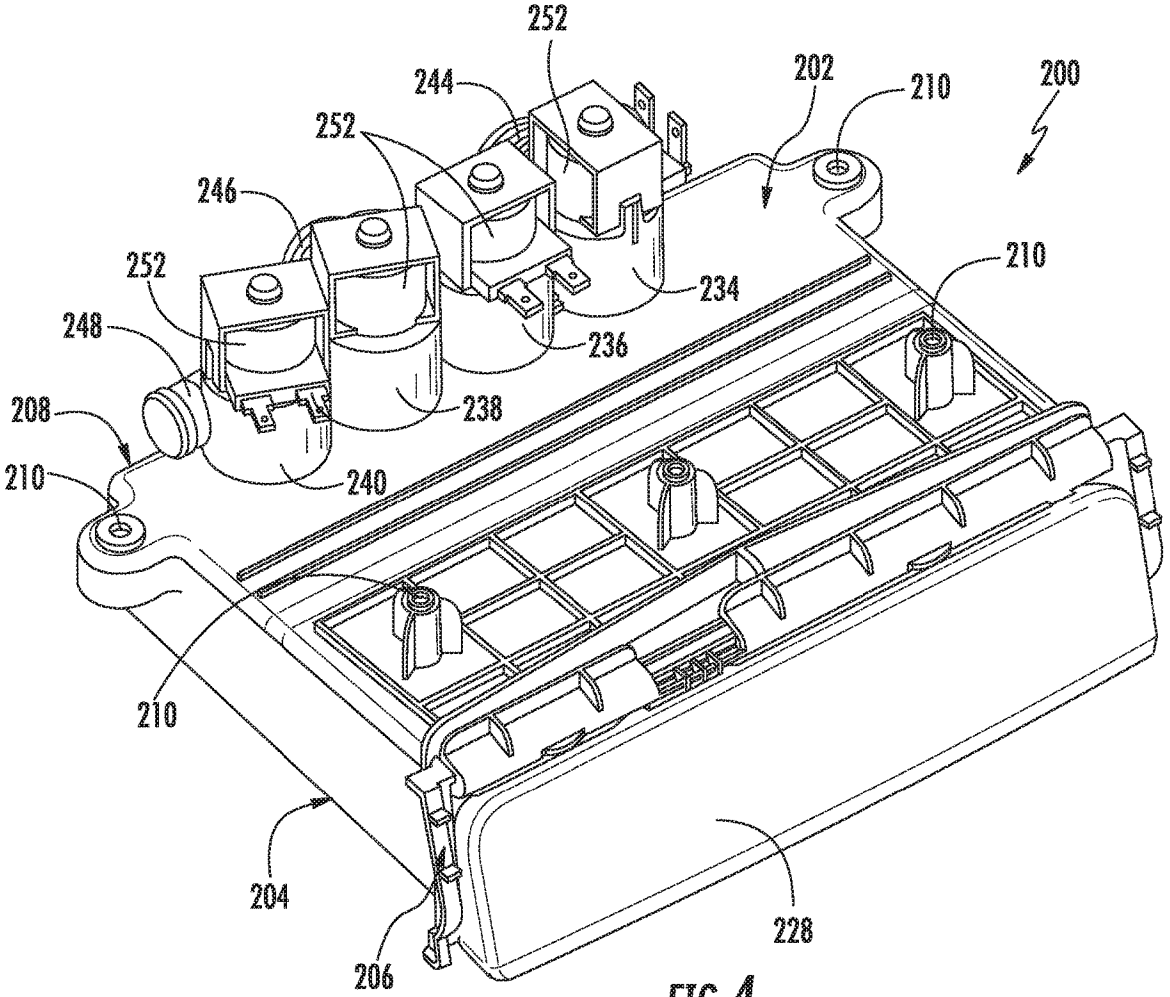
FIG. 4 provides a front, perspective view of the additive dispenser of FIG. 3.

Referring now generally to FIGS. 2 through 4, additive dispenser 200 will be described in more detail. Although the discussion below refers to additive dispenser 200, one skilled in the art will appreciate that the features and configurations described may be used for other additive dispensers in other washing machine appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

Additive dispenser 200 is a box having a substantially rectangular cross-section that defines a top 202 and a bottom 204 spaced apart along the vertical direction V. Additive dispenser 200 also defines a front side 206 and a back side 208 spaced apart along the transverse direction T. As best shown in FIGS. 2 and 3, additive dispenser 200 may be mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

Additive dispenser 200 may define a mixing chamber 220 configured to receive one or more additive compartments. For example, according to the illustrated embodiment, mixing chamber 220 may be configured to slidably receive a detergent compartment 222 and a softener compartment 224. Compartments 222, 224 are slidably connected to the mixing chamber 220 using slides 226 and are connected to a front panel 228 of additive dispenser. In this manner, a user may pull on front panel 228 to slide compartments 222, 224 along the transverse direction T. Once extended, detergent compartment 222 and softener compartment 224 may be conveniently filled with detergent and softener, respectively. Front panel 228 may be then be pushed back into mixing chamber 220 before a wash cycle begins.

Although the illustrated embodiment shows detergent compartment 222 and softener compartment 224 slidably received in mixing chamber 220 for receiving wash additives, one skilled in the art will appreciate that different configurations are possible in alternative exemplary embodiments. For example, more compartments may be used and the compartments may be accessed by a lid instead of sliding out of mixing chamber 220. Alternatively, mixing chamber 220 may draw wash additives from a separate storage container such that sliding compartments 222, 224 are not needed. Other configurations of mixing chamber 220 and compartments 222, 224 are also possible and within the scope of the present subject matter.

Additive dispenser 200 may further include a plurality of valves configured to supply hot and cold water to mixing chamber 220 or directly to wash tub 121. For example, according to the illustrated embodiment, a plurality of apertures may be defined on top 202 of mixing chamber 220 for receiving water. Each aperture (not shown) may be in fluid communication with a different portion of the mixing chamber. A plurality of valve seats may be positioned over top of each of those apertures to receive a valve that controls the flow of water through each aperture.

For example, a first valve seat 234 may be in fluid communication with a first aperture for providing hot water into detergent compartment 222. A second valve seat 236 may be in fluid communication with a second aperture for providing cold water into detergent compartment 222. A third valve seat 238 may be in fluid communication with a third aperture for providing cold water into softener compartment 224. A fourth valve seat 240 may be in fluid communication with a fourth aperture for providing cold water into mixing chamber 220 or directly into wash tub 121.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. However, because washing machine appliance 100 uses cold water for multiple purposes, cold water inlet is in fluid communication with a cold water manifold 248. Cold water manifold 248 may be a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Additive dispenser 200 may further include one or more nozzles (not shown) for directing wash fluid, such as water and/or a mixture of water and at least one fluid additive, e.g., detergent, fabric softener, and/or bleach into wash tub 121 from additive dispenser 200. For example, when second valve seat 236 is open, water may flow from cold water inlet 246 through cold water manifold 248 and second valve seat 236 into detergent compartment 222. Water may mix with detergent placed in detergent compartment 222 to create wash liquid to be dispensed into wash tub 121.

A nozzle (not shown) may be placed on the bottom of detergent compartment 222 or on the bottom of mixing chamber 220 to dispense the wash fluid into wash tub 121. According to the illustrated embodiment, additive dispenser 200 may include four nozzles associated with valves seats 234, 236, 238, 240, respectively. However, it will be understood that different nozzle configurations may be used in alternative exemplary embodiments. For example, nozzles may be positioned on a bottom of mixing chamber 220 near wash tub 121 or directly on wash tub 121, but could be positioned in other locations as well.

As discussed herein, in some situations, a user may wish to cause the flow of water separate from the flows associated with typical wash cycles. For example, a user may wish to obtain water for use when pretreating articles in a wash basin, as discussed herein. The user may thus utilize a suitable input selector 112 or other dedicated input to cause water to be flowed on-demand and independently of the typical wash cycles of the washing machine appliance 100.

Referring now to FIGS. 5 through 8, embodiments of a wash basin 300 utilized with a washing machine appliance 100 are provided. Wash basin 300 is a discrete, removable component of washing machine appliance 100. Advantageously, the wash basin 300 can be inserted into and supported within washing machine appliance 100 when needed, such as for soaking, pretreating, etc. Further, the wash basin 300 can advantageously be removed and stored out of the way when not needed. In some cases, the wash basin 300 when not in use can provide auxiliary uses, such as as a stepstool. Additionally, the easy removal of such wash basins 300 advantageously facilitates ease of cleaning the wash basins 300. Still further, wash basins 300 in accordance with the present disclosure may be shipped in the inserted position within a washing machine appliance 100, and may be designed to limit movement of the wash basket 120 and balance ring thereof during shipment, thus reducing or eliminating the need for additional packing material for this purpose.

Wash basins 300 in accordance with the present disclosure may be formed from any suitable materials. For example, in some embodiments, a wash basin 300 may be formed from a plastic. In some embodiments, a wash basin 300 may be injection molded, and may thus be formed from an injection molded material such as an injection molded plastic. In some embodiments, a maximum wall thickness of the wash basin 300 may be less than or equal to 0.2 inches, such as less than or equal to 0.15 inches, such as less than or equal to 0.1 inches.

As shown, top panel 140 defines opening 105. Further, top panel 140 includes a surface 142 which defines opening 105. The surface 142 is, as shown, a generally curvilinear surface which may be at least partially ring-shaped. Further, surface 142 is a convex surface 142. The wash basin 300 may be removably positionable within the opening 105, and may include a first sidewall 302 and an opposing second sidewall 304 spaced apart from the first sidewall 302, such as along the lateral direction L when the wash basin 300 is inserted in the washing machine appliance 100. The first and second sidewall 302, 304 may be curvilinear, and may further each have a convex shape, as shown, which corresponds to the convex surface 142 of the top panel 140. According, when inserted, the first and second sidewalls 302, 304 may contact the convex surface 142 to position the wash basin 300 within the opening 105 and washing machine appliance 100 generally.

Wash basin 300 may further include a first end wall 306 and an opposing second end wall 308 spaced apart from the first end wall 306, such as along the transverse direction T when the wash basin 300 is inserted in the washing machine appliance 100. In some embodiments, the end walls 306, 308 may be planar walls, as shown. Alternatively, the end walls 306, 308 or portions thereof may be curvilinear and/or may have convex or concave curvatures. The sidewalls 302, 304 and end walls 306, 308 may together form an outer periphery of the wash basin 300.

As shown, a cutout 310 may be defined in the first end wall 306, such as between the first sidewall 302 and second sidewall 304 along the lateral direction L when the wash basin 300 is inserted in the washing machine appliance 100. The cutout 310 may allow access by the additive dispenser 200 to the wash basin 300, and may thus facilitate the flow of water into the wash basin 300 from the additive dispenser 200 into the wash basin 300. For example, the cutout 310 may be sized and shaped such that, when the wash basin 300 is inserted in the washing machine appliance 100, the additive dispenser 200 is accessible to a user as discussed herein.

In some embodiments, wash basin 300 may further include an inlet panel 312 which may extend between portions of the first end wall 306 that define the cutout 310 therebetween. Accordingly, inlet panel 312 may further define the cutout 310. When the wash basin 310 is in the inserted position, the inlet panel 312 may be positioned adjacent to and in some embodiments in contact with the additive dispenser 200. Water from the additive dispenser 200 may flow onto the inlet panel 312, and from the inlet panel 312 into the wash basin 300 generally. For example, in some embodiments, the inlet panel 312 may be angled to facilitate such flow of water. More specifically, the inlet panel 312 may be angled relative to a lateral-transverse plane defined by the lateral direction L and the transverse direction T. Such angle 313 may be greater than 0, such as between 0.5 and 15 degrees, and is illustrated for example in FIG. 8.

A wash basin 300 in accordance with the present disclosure may include an upper portion 320 and a lower portion 322. The lower portion 322 may be below the upper portion 320 along the vertical direction V. The upper portion 320 may include, for example, the first and second sidewalls 302, 304 and the first and second end walls 306, 308. A step 324 may be disposed between the upper portion 320 and the lower portion 322, and may define the upper portion 320 and lower portion 322. The step 324 may, for example, be an inwardly extending step, and may thus extend inward from the periphery of the upper portion 320 and define an interior base of the upper portion 320. The interior volume of the lower portion 322 may thus be less than the interior volume of the upper portion 320. Further, a cross-sectional area of the lower portion 322 (taken in the lateral-transverse plane) may be less than a cross-sectional area of the upper portion 320.

Lower portion 322 may include a third sidewall 332 and an opposing fourth sidewall 334 spaced apart from the third sidewall 332, such as along the lateral direction L when the wash basin 300 is inserted in the washing machine appliance 100. The third and fourth sidewall 332, 334 may be curvilinear, as shown. Lower portion 322 may further include a third end wall 336 and an opposing fourth end wall 338 spaced apart from the third end wall 336, such as along the transverse direction T when the wash basin 300 is inserted in the washing machine appliance 100. In some embodiments, the end walls 336, 338 may be planar walls, as shown. Alternatively, the end walls 336, 338 or portions thereof may be curvilinear and/or may have convex or concave curvatures. The sidewalls 332, 334 and end walls 336, 338 may together form an outer periphery of the lower portion 322.

It should be understood that the wash basin 300 need not include a lower portion 322 which is defined separately from an upper portion 320 as discussed above. For example, sidewalls 302, 304 and end walls 306, 308 may extend all the way to a bottom wall of the wash basin 300. In some embodiments, the various sidewalls and end walls may taper to reduce the cross-section area along the depth of the wash basin 300, while in other embodiments no such taper is required.

Figure 5:
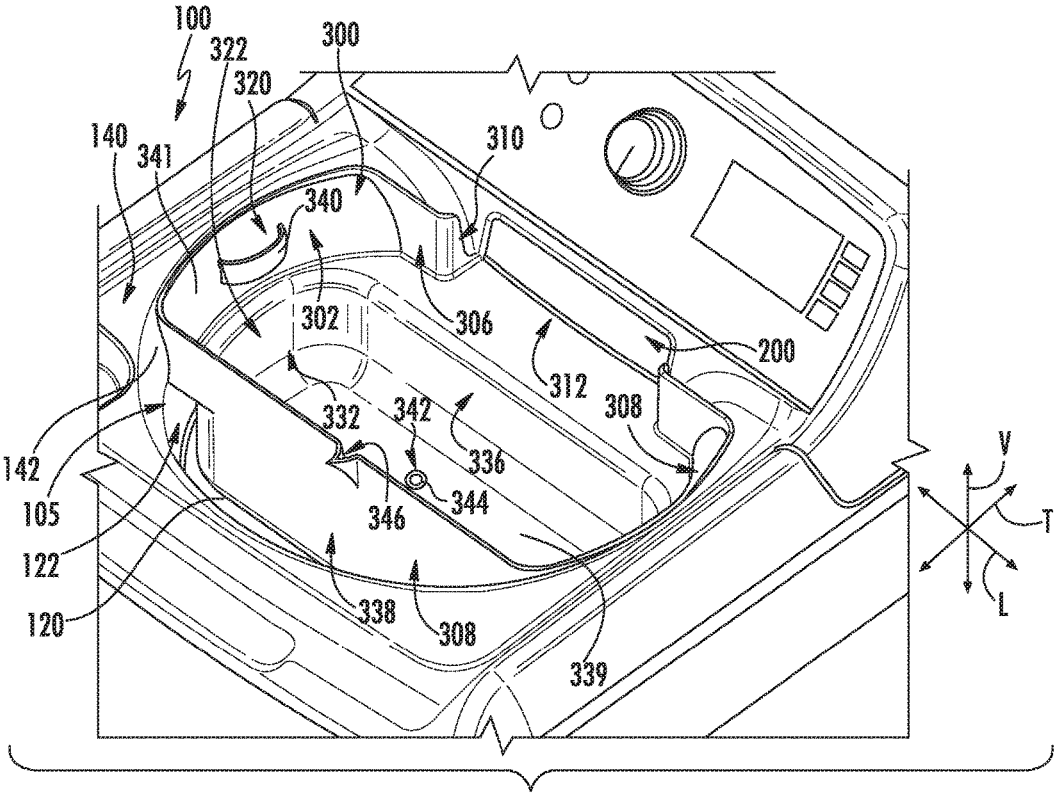
FIG. 5 is a top perspective view of a portion of a washing machine appliance with a wash basin inserted therein in accordance with embodiments of the present disclosure.
Figure 6:
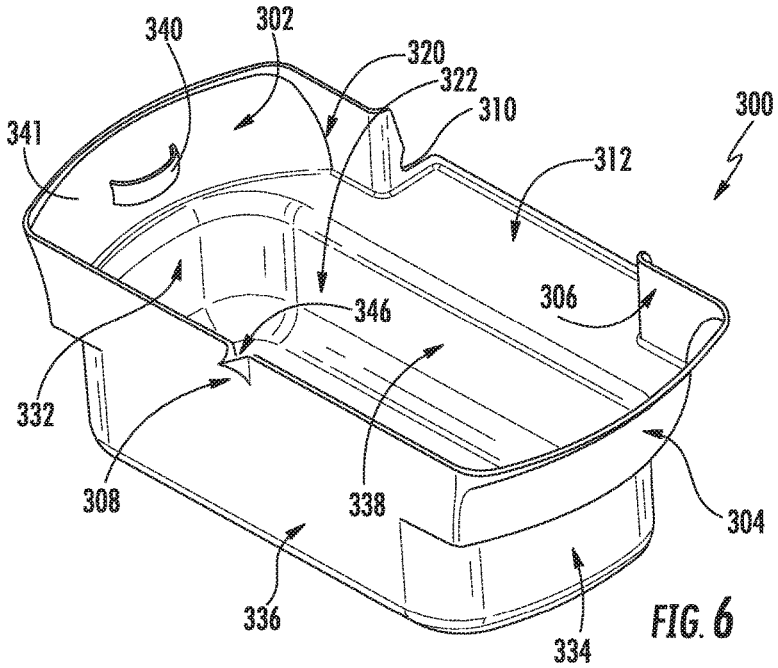
FIG. 6 is a top perspective view of a wash basin removed from a washing machine appliance in accordance with embodiments of the present disclosure.
Figure 7:
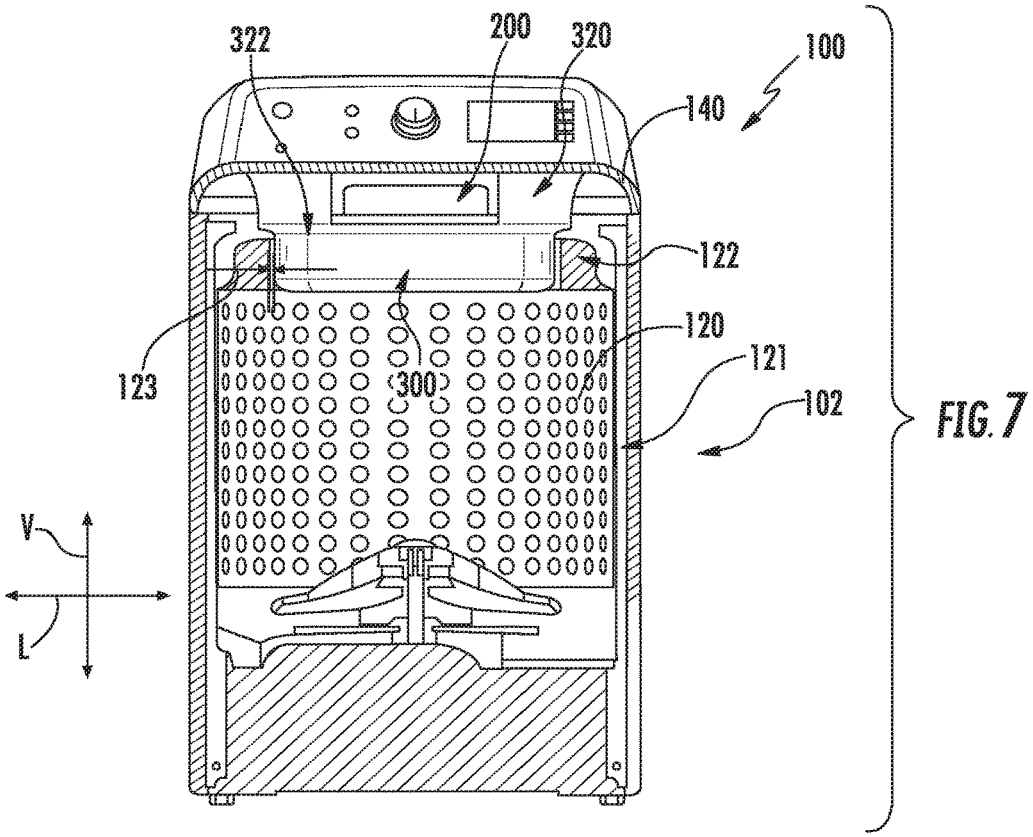
FIG. 7 is a front cross-sectional view of a washing machine appliance in accordance with embodiments of the present disclosure.
Figure 8:
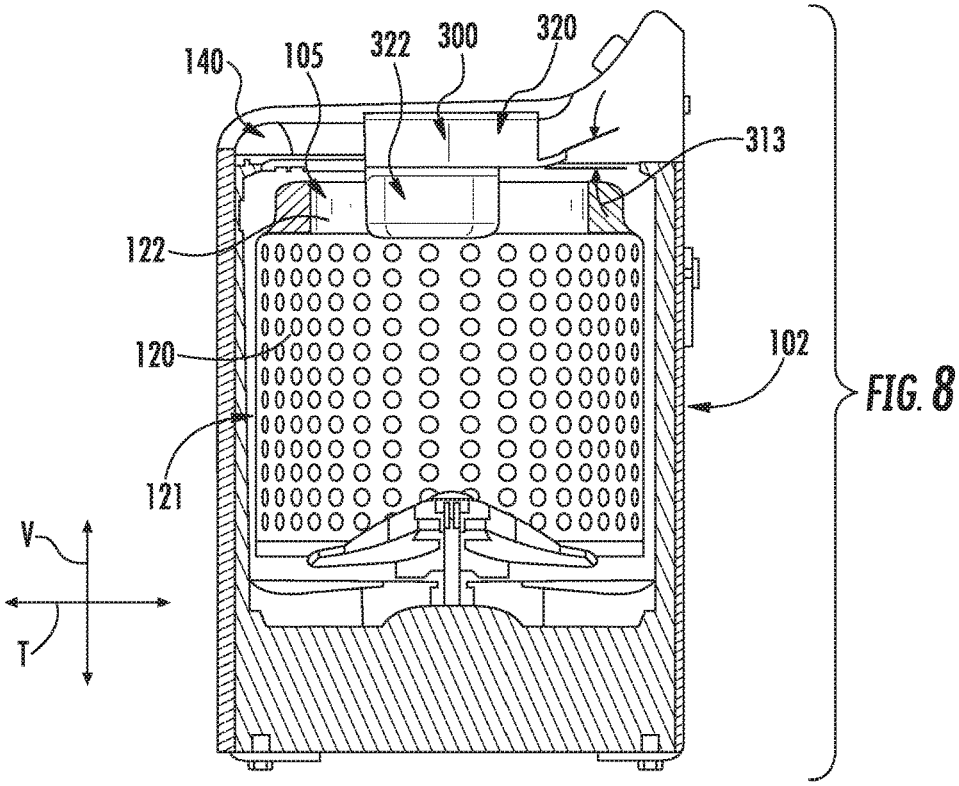
FIG. 8 is a side cross-sectional view of a washing machine appliance in accordance with embodiments of the present disclosure.

As shown in FIGS. 5 and 7, the washing machine appliance 100 and wash basket 120 thereof may include a balance ring 122. Balance ring 122 facilitates relatively smooth, balanced rotation of the basket 120 during operation, as is generally understood. The balance ring 122 is disposed at the top of basket 120 along the vertical direction V. In some embodiments, as shown, lower portion 322 of the wash basin 300 extends into the basket 120, adjacent the balance ring 122, when in the inserted position. When in the inserted position, a gap 123 may be defined along the lateral direction L between the lower portion 122 (such as the first sidewall 332 or second sidewall 334) and the balance ring 122. The gap 123 may, for example, be less than or equal to 1 inch, such as between 0.005 inches and 1 inch, such as between 0.05 inches and 0.5 inches. Such gap 123 may, for example, be defined for both the first sidewall 332 and the second sidewall 334. Such relatively small gaps 123 may limit movement of the wash basket 120 and balance ring 122 thereof during shipment, as discussed above.

As discussed, wash basin 300 when in the inserted position may be disposed within opening 105. However, access through opening 105 may still be provided despite the wash basin 300 being so inserted. For example, as shown, a maximum cross-sectional area of the wash basin 300 (as taken in the lateral-transverse plane) may be less than a maximum cross-sectional area of the opening 105. While the first and second sidewalls 302, 304 may contact the top panel 140, the second sidewall 308 and in some embodiments the first sidewall 306 may be spaced from the top panel 140. Accordingly, access to the wash basket 120 and wash tub 121 may be provided during use of the wash basin 300.

Wash basin 300 may further include one or more features for handling of the wash basin 300 and liquid management of the wash basin 300. For example, in some embodiments, wash basin 300 may include one or more handles 340. Each handle 340 may extend from a wall of the wash basin 300, such as in exemplary embodiments one of the first sidewall 302 (as shown), second sidewall 304 (as shown), third sidewall 306, and/or fourth sidewall 308. Further each handle 340 may in some embodiments as shown extend from an inner surface 341 of such wall (i.e. the first sidewall 302 and/or second sidewall 304) into the interior of the wash basin 300.

In some embodiments, wash basin 300 may further include a drain hole 342 defined therein. In exemplary embodiments, the wash basin 300 may be defined in a base wall 339 which, along with the walls 332, 334, 336, 338, defines the lower portion 322. Wash basin 300 may additionally include a plug 344 which may be removably positionable within drain hole 342 to selectively prevent drainage through drain hole 342.

In some embodiments, wash basin 300 may further include a spout 346 defined therein. Spout 346 may facilitate the pouring of liquid from the wash basin 300. In some embodiments, for example, spout 346 may be defined in the second end wall 308.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet, the cabinet comprising a top panel which defines an opening, the top panel comprising a convex surface defining the opening;

a tub positioned within the cabinet;

a wash basket rotatably mounted within the tub, the wash basket defining a wash chamber for receiving articles for washing;

an additive dispenser positioned within the cabinet and configured to provide wash liquid to the tub;

a balance ring attached to the wash basket; and a wash basin removably positionable within the opening, the wash basin comprising a first sidewall and an opposing second sidewall, the first and second sidewalls each having convex shapes which correspond to the convex surface defining the opening, wherein the wash basin further comprises a first end wall and an opposing second end wall, the first and second end walls each extending between the first and second sidewalls, and wherein a cutout is defined in the first end wall, wherein the cutout allows access by the additive dispenser to the wash basin, wherein the wash basin extends along the vertical direction from an upper portion and a lower portion, wherein the lower portion is positioned below at least a portion of the balance ring along the vertical direction, and wherein a gap is defined along the lateral direction between the lower portion and the balance ring.

2. The washing machine appliance of claim 1, wherein the wash basin further comprises an inlet panel defining the cutout, the inlet panel being angled relative to a lateral-transverse plane.

3. The washing machine appliance of claim 1, wherein the upper portion comprises the first sidewall and opposing second sidewall, and wherein the wash basin further comprises a step disposed between and defining the upper portion and the lower portion.

4. The washing machine appliance of claim 1, wherein the gap is less than or equal to 1 inch along the lateral direction.

5. The washing machine appliance of claim 3, wherein the lower portion comprises a third sidewall, an opposing fourth sidewall, a third end wall, and an opposing fourth end wall, the third and fourth end walls each extending between the third and fourth sidewalls, and wherein the third and fourth sidewalls are curvilinear.

6. The washing machine appliance of claim 1, wherein the wash basin further comprises a handle.

7. The washing machine appliance of claim 6, wherein the handle extends from an inner surface of one of the first sidewall or the second sidewall.

8. The washing machine appliance of claim 1, further comprising a drain hole defined in the wash basin.

9. The washing machine appliance of claim 1, further comprising a spout defined in the wash basin.

10. The washing machine appliance of claim 1, wherein a maximum cross-sectional area of the wash basin is less than a maximum cross-sectional area of the opening.

11. A washing machine appliance defining a vertical, a lateral, and a transverse direction, the washing machine appliance comprising:

a cabinet, the cabinet comprising a top panel which defines an opening;

a tub positioned within the cabinet;

an additive dispenser positioned within the cabinet and configured to provide wash liquid to the tub;

a wash basket rotatably mounted within the tub, the wash basket comprising a balance ring and defining a wash chamber for receiving articles for washing; and a wash basin removably positionable within the opening, the wash basin comprising an upper portion, a lower portion, and a step disposed between and defining the upper portion and the lower portion, the upper portion comprising a first sidewall and opposing second sidewall, wherein a gap is defined along the lateral direction between the lower portion and the balance ring, wherein the wash basin further comprises a first end wall and an opposing second end wall, the first and second end walls each extending between the first and second sidewalls, wherein a cutout is defined in the first end wall, wherein the cutout allows access by the additive dispenser to the wash basin, wherein the lower portion is positioned below at least a portion of the balance ring along the vertical direction, and wherein the gap is less than or equal to 1 inch along the lateral direction.

12. The washing machine appliance of claim 11, wherein the wash basin further comprises an inlet panel defining the cutout, the inlet panel being angled relative to a lateral-transverse plane.

13. The washing machine appliance of claim 11, wherein the lower portion comprises a third sidewall, an opposing fourth sidewall, a third end wall, and an opposing fourth end wall, the third and fourth end walls each extending between the third and fourth sidewalls, and wherein the third and fourth sidewalls are curvilinear.

14. The washing machine appliance of claim 11, wherein a maximum cross-sectional area of the wash basin is less than a maximum cross-sectional area of the opening.

* * * * *